United States Patent [19]

Oka et al.

[11] 3,997,864

[45] Dec. 14, 1976

[54] VARIABLE RESISTOR

[75] Inventors: Shunzo Oka, Hirakata; Kazuo Oshima, Osaka, both of Japan

[73] Assignee: Matsushita Electric Industrial Co., Ltd., Japan

[22] Filed: May 31, 1974

[21] Appl. No.: 475,055

[52] U.S. Cl. ..... 338/119; 338/162; 338/196

[51] Int. Cl.[2] ..... H01C 10/30

[58] Field of Search ..... 338/119, 131, 134, 135, 338/162, 196; 200/167 A; 116/124.4, 129 P, 129 L; 240/1 LP, 2.1; 350/96 B

[56] References Cited

UNITED STATES PATENTS

| | | | |
|---|---|---|---|
| 1,997,258 | 4/1935 | Krieger | 338/119 |
| 2,457,920 | 1/1949 | Rider | 338/119 |
| 2,469,924 | 5/1949 | Kunz, Jr. | 338/119 |
| 2,492,286 | 12/1949 | Hermann | 338/119 |
| 2,650,270 | 8/1953 | Mucher | 338/129 X |
| 3,143,098 | 8/1964 | Blackwell | 240/1 LP |
| 3,373,393 | 3/1968 | Hauenstine et al. | 338/134 |
| 3,544,749 | 12/1970 | De Angelo | 350/96 B X |
| 3,611,245 | 10/1971 | Puerner | 338/134 |
| 3,697,921 | 10/1972 | Urwin | 338/131 |
| 3,848,219 | 12/1974 | Oka | 338/119 |

*Primary Examiner*—C. L. Albritton
*Attorney, Agent, or Firm*—Burgess, Ryan and Wayne

[57] ABSTRACT

A variable resistor is disclosed which may readily attain or reproduce a preset value. A wiper arm or plate is carried by an outer shaft for rotation with a wiper in sliding contact with a resistor so that the resistance value may be continuously varied in a conventional manner. In order to detect the angular position of the outer shaft where a preset value is obtained, a click mechanism is incorporated. A click spring of the click mechanism is fixed to a switching plate carried by an inner shaft fitted into the outer shaft for rotation therewith or independently thereof in case of presetting, and a ball loosely carried at the free end of the click spring is adapted to engage with a recess formed at a predetermined position of a stationary click plate so that the inner shaft may be stopped at a predetermined angular position. To preset, one rotates the outer shaft to a desired resistance value, and then while holding the outer shaft stationary, he rotates only the inner shaft until it is stopped by the click mechanism. After presetting, a preset value is readily reproduced when one rotates both the outer and inner shafts until and they are stopped by the click mechaism. Furthermore, the variable resistor incorporates a switch so arranged that when, and only when the inner shaft is stopped by the click mechanism, the switch is closed to turn on an indicator lamp.

15 Claims, 2 Drawing Figures

VARIABLE RESISTOR

BACKGROUND OF THE INVENTION

The present invention relates generally to a variable resistor and more particularly, to a variable resistor provided with a mechanism capable of indicating the angular position of the operating shaft of the variable resistor at which a preset resistance is obtained or reproduced.

In general, the conventional rotary variable resistors are not provided with means or mechanisms for indicating the angular position of the operating shaft at which a preset or previously used resistance may be reproduced so that one must remember the angular position at which a desired resistance may be obtained.

SUMMARY OF THE INVENTION

One of the objects of the present invention is therefore to provide a variable resistor provided with a click stop mechanism so that a preset or previously used resistance may be readily reproduced.

Another object of the present invention is to provide a variable resistor capable of indicating that a desired resistance is obtained or set, by turning on a light source such as a lamp.

A further object of the present invention is to provide a variable resistor capable of readily reproducing a desired volume level.

Briefly stated, according to the present invention, a double shaft consisting of an outer shaft and an inner shaft fitted into the outer shaft for rotation in unison therewith by the friction therebetween is used, but when a desired resistance value is preset, the outer or inner shaft may be rotated independently of the other. A wiper arm or wiper plate is carried by the outer or inner shaft so that the resistance may be varied as the outer or inner shaft is rotated in a conventional manner. A click spring of a click mechanism is fixed to a switching plate carried by the inner or outer shaft in such a manner that a click means such as a ball at the free end of the click spring may engage with a mating means such as a hole or recess formed in a stationary click plate disposed within a cover. First, one rotates the outer or inner shaft to obtain a desired resistance value and then rotates the inner or outer shaft, while the outer or inner shaft is held stationary, until the inner or outer shaft is stopped by the click mechanism. Therefore, when one rotates both the outer and inner shafts simultaneously from any position until the double shaft is stopped by the click mechanism, a preset resistance is readily and precisely reproduced.

According to another aspect of the present invention, a switch is so arranged that only when the inner or outer shaft is stopped by the click mechanism, the switch is closed to turn on a lamp so that one may more readily attain a desired resistance value.

DETAILED DESCRIPTION OF THE PREFERRED EMBODIMENT

Figure 1:
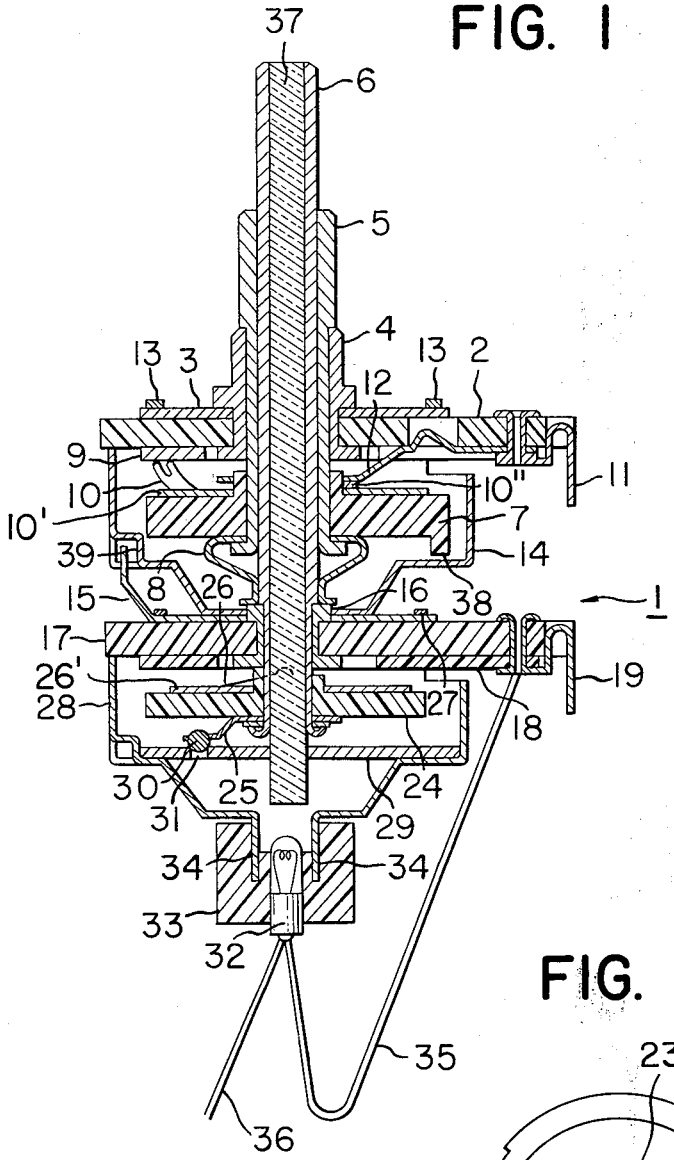
FIG. 1 is a longitudinal sectional view of a variable resistor in accordance with the present invention.

Referring to FIG. 1, a variable resistor generally indicated by 1 has a hollow outer shaft 5 rotatably fitted into a bearing 4 which in turn is mounted through a shield plate 3 upon a first mount 2 made of an electrically insulating material. A hollow inner shaft 6 is rotatably fitted into the outer shaft 5. At the lower end of the outer shaft 5 is securely fitted a wiper supporting member 7, and one end of friction springs 8 are sandwiched between the lower surface of the wiper supporting member 7 and the transversely projected lower end of the outer shaft 5 while the other ends of the friction springs 8 are firmly pressed against the outer side surface of the inner shaft 6 so that both the outer and inner shafts 5 and 6 may be rotated in unison or one of them may be rotated freely when the other is held stationary.

Upon the lower surface of the mount 2 is attached a horseshoe-shaped resistor member 9 which contacts a wiper finger 10 extending from a wiper ring 10 mounted on wiper supporting member 7. The wiper finger 10 is electrically connected to a contactor 12 by way of a further sliding finger 10'' of the ring 10', and thence to a center or wiper terminal 11 carried by the mount 2, so that the conventional variable resistor circuit may be established between an outer terminal (not shown and connected to one end of the resistor member 9) and the center or wiper terminal 11.

Figure 2:
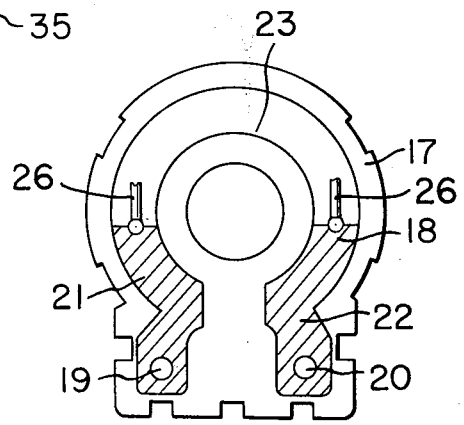
FIG. 2 is a bottom view of a switch plate thereof and showing relative positions of the contacts on the switch plate.

A cap-shaped metallic cover 14 is securely attached to the bottom of the mount 2 with suitable fastening means 13 through the shield plate 3 so as to cover the wiper supporting member 7 and the friction springs 8. The bottom of the metallic cover 14 is fixed through a shield plate 15 to a second mount 17 which is made of an electrically insulating material and carries a bearing 16 for the inner shaft 6. Upon the bottom or lower surface of the second mount 17 is attached a horseshoe-shaped switch plate 18 with suitable fastening means 19 and 20 which in turn serve as connection terminals. As seen in FIG. 2, the switch plate 18 comprises conductor segments or sections 21 and 22 electrically connected to the terminals 19 and 20, respectively, and an insulator segment or section 23. At the lower end portion of the inner shaft 6 is fitted a switching plate 24 made of an electrically insulating material with, and a click spring 25 is held to the bottom of plate 24. A pair of switch contacts 26 extend upwardly from conductive ring 26' affixed to the upper surface of the switching plate 24, the contacts 26 being in opposed relation (i.e. symmetrically about the axis of the inner shaft 6) (as seen in FIG. 2) and electrically interconnected have fingers formed at the leading ends thereof for sliding contact with the switch plate 18. Therefore, when both the fingers of the switch contacts 26 are brought into contact with the conductor segments or sections 21 and 22 on the switch plate 18, the current flows between the terminals 19 and 20, but no current flows between them when one of the fingers is brought into contact with the conductor section 21 or 22 while the other finger is in contact with the insulator section 23. Insulator section 23 comprises a 180° segment defined above a horizontal line (not shown) which includes therein the joints between the insulating and conductive portions 23, and 21, 22, said line being below the center of the second mount 17 and normal to a vertical line passing through the center thereof.

A second cap-shaped metallic cover 28 is attached to the lower surface of the second mount 17 through the shield plate 15 with suitable fastening means 27. Within the metallic cap 28 is disposed a click plate 29 which has a hole or recess 31 into which engages about one third of a ball 30 loosely carried by the free end of the click spring 25. The position of this hole or recess 31 is so selected that when the fingers of both contacts 26 carried by the switching plate 24 are brought into contact with the conductor sections or segments 21 and 22 upon the switch plate 18, the ball 30 engages with the hole or recess 31. Therefore, when the switching plate 18 is click-stopped, the switch contacts 26 bridge between the terminals 19 and 20.

The bottom of the second metallic cover 28 terminates into a cylindrical portion 34 of a reduced diameter which carries a socket or holder 33 for a lamp 32. One lead wire 35 of the lamp 32 is connected to the terminal 19 while the other lead wire 36 is connected to one terminal of a rated power source (not shown). The terminal 20 is connected to the other terminal of this power source. The lower end of an optical glass rod 37 which and fitted into the inner shaft 6 extends out of the lower end thereof as close to the lamp 32 as possible so that the light emitted from the lamp 32 may be transmitted through the optical glass rod 37 with the maximum efficiency.

A stop or projection 38 extends downwardly from the lower surface of the first mount 7. A mating stop or projection 39 is formed integrally of the first metallic cover 14 and is provided for engagement with the stop or projection 38 in order to limit the angle of rotation of the outer shaft 5.

Next, the mode of operation of the variable resistor with the above construction will be described. As in the case of the conventional variable resistor, the wiper finger 10 slides over the resistor member 9 upon rotation of the outer shaft 5 so that the resistance between the center or wiper terminal 11 and the outer terminal may be varied within the selected resistance parameters of resistance element 9. Thereafter, the outer shaft 5 is released, and the inner shaft 6 is rotated separately until it is click-stopped, that is, the ball 30 carried by the click springs 25 engages with the hole or recess 31 of the click plate 29. Once the variable resistor 1 is set in the manner described above, a desired resistance between the terminals of the variable resistor may be reset following a later adjustment of the resistor, if both the outer and inner shafts 5 and 6 are rotated simultaneously until they are stopped by the spring click. The simultaneous rotation of the two shafts may be effected by physically rotating only one of them, for example the outer shaft 5, due to the frictional coupling of the shafts by the springs 8.

When the rotation of the inner shaft 6 is stopped by the click mechanism, the fingers of the contacts 26 are brought into contact with the conductor segments 21 and 22 as shown in FIG. 2 so that the lamp 32 is turned on. Therefore, one may know not only by the click produced by the click mechanism but also the light emitted from the lamp, that a desired or preset resistance is obtained. It should be noted here that when the rotation of the inner shaft 6 is not stopped by the click mechanism the lamp 32 is not turned on. Thus, the angle of rotation of the outer shaft 5 required to obtain a desired resistance may be memorized by the click mechanism and the turned-on lamp.

In the instant embodiment, the outer shaft 5 has been described as being rotated to vary the resistance while the inner shaft 6 being stopped by the click mechanism to turn on the lamp 32, but it will be obvious to those skilled in the art that their functions may be reversed. Furthermore, only one of the spring click and the lamp may be used to indicate that a desired resistance is obtained, but it is obvious that it is more advantageous in practice to use both of them.

What is claimed is:

1. In a variable resistor assembly of the type having an outer rotatable control shaft, an inner control shaft extending coaxially through said outer shaft and rotatable therein, a variable resistor, and means mechanically coupled to one of said shafts for varying the resistance of said variable resistor with rotation of said shaft; the improvement comprising a click mechanism coupled to the other said shaft, and means frictionally intercoupling said inner and outer shafts whereby each shaft rotates in unison with the other when only a single shaft is rotated and each shaft may be separately rotated while restraining the other, said click mechanism comprising a click spring mounted for rotation with said other shaft, a click plate affixed to said resistor assembly whereby said other shaft is rotatable with respect to said click plate, and a click engaging means mounted on said click spring and positioned to engage said click plate, said click plate having means responsive to movement of said click engaging means to a determined angular position to provide an audible indication.

2. The variable resistor assembly of claim 1 wherein said means for varying the resistance of said variable resistor is mechanically coupled to said outer shaft, and said click spring is mounted for rotation with said inner shaft.

3. The variable resistor assembly of claim 1 wherein said click engaging means comprises a ball loosely carried at the end of said click spring away from said other shaft.

4. The variable resistor assembly of claim 3 wherein said means responsive to movement of said click engaging means comprises a recess in said click plate positioned to engage said ball at a determined angular displacement of said other shaft with respect to said click plate.

5. The variable resistor assembly of claim 1 wherein said variable resistor comprises a resistance element fixedly mounted to partially encircle said one shaft in a plane normal to the axis of said one shaft, wiper means positioned to resiliently engage said resistance, means mounting said wiper means for rotation with said one shaft, and contact means mounted in a fixed position with respect to said resistor and positioned to slidably engage said wiper means.

6. In a variable resistor assembly of the type having a rotatable outer control shaft, an inner control shaft extending coaxially through said outer control shaft and rotatable therein, a variable resistor, and means mechanically coupled to one of said control shafts for varying the resistance of said variable resistor with rotation of said one control shaft; the improvement comprising means operably coupled to said other control shaft for indicating the setting of said variable resistor at a determined position, and means fixedly intercoupling said first and second control shafts whereby each control shaft rotates in unison with the other when only a single control shaft is rotated and each control shaft may be separately rotated while restraining the other, said means for indicating the setting of said variable resistor comprising a switch having first contact means fixedly mounted with respect to said other control shaft and second contact means mechanically coupled to rotate with said other control shaft, said first and second contact means being positioned to establish an electrical path therethrough only at a determined angular displacement of said other control shaft, and a light source mounted on said variable resistance assembly and connected for operation to said switch, for visually indicating the placement of said other control shaft at said determined angular displacement.

7. The variable resistor assembly of claim 6 wherein said first contact means comprises a fixedly mounted insulating plate having at least one conductive segment thereon, and said second contact means comprises a wiper arm mechanically coupled for rotation with said other shaft, said wiper arm being positioned to slidably engage said insulating plate and contact said conductive segment at said determined angular displacement of said other shaft.

8. The variable resistor assembly of claim 7 wherein said means for varying the resistance of said variable resistor is mechanically coupled to said outer shaft and said wiper arm is mechanically coupled to said inner shaft.

9. The variable resistor of claim 6 wherein said first contact means comprises a horse shoe shaped switch plate fixedly mounted to surround said other shaft in a plane normal to the axis of said other shaft, said switch plate having an insulator segment of substantially 180° and a separate conductor segment adjacent each end of said insulator segment, said second contact means comprising a pair of wiper arms positioned to slidably engage said switch plate at opposite sides of said other shaft, and means electrically connecting said wiper arms.

10. The variable resistor assembly of claim 9 further comprising a second switching plate connected to said other shaft, said wiper arms being mounted on said second switching plate.

11. The variable resistor assembly of claim 9 wherein said insulator segment is above a horizontal line passing through below the center and normal to the vertical line about which said horse shoe shaped switch plate is symmetrical, and said two conductor segments are below said insulator segment.

12. The variable resistor of claim 6 wherein said light source is mounted adjacent one end of said inner shaft, and further comprising an optical glass rod mounted in said inner shaft for transmitting light emitted from said light source through said inner shaft, whereby illumination of said light source is visible at said other end of said second shaft.

13. The variable resistor of claim 1 further comprising a holder for said light source, said holder comprising a metallic cover fixedly positioned adjacent one end of said other shaft.

14. The variable resistor assembly of claim 13 wherein said holder has a reduced diameter portion adjacent said end of said shaft, said light source being mounted in said reduced diameter portion.

15. The variable resistor assembly of claim 6 further comprising a click mechanism coupled to said other shaft, said click mechanism comprising a click spring fixed for rotation to said other shaft, a click plate fixedly mounted on said resistor assembly whereby said other shaft is rotatable with respect to said click plate, and a click engaging means mounted on said click spring and positioned to engage said click plate, said click plate having means responsive to movement of said click engaging means to said determined angular displacement of said other shaft to produce an audible indication.

* * * * *

UNITED STATES PATENT OFFICE

CERTIFICATE OF CORRECTION

Patent No. 3,997,864 Dated December 14, 1976

Inventor(s) Shunzo Oka, et al

It is certified that error appears in the above-identified patent and that said Letters Patent are hereby corrected as shown below:

Column 2, line 21: "10" (last occurrence) should be --10'--.

Column 2, line 46: After "material" insert a comma.

Column 2, line 47: Delete "with,".

Column 3, line 44: "springs" should be --spring--.

Column 3, line 48: After "reset" insert a comma.

Column 6, line 18: "claim 1" should be --claim 6--.

Column 6, line 24: "shaft" should be --other shaft--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*